US008982166B2

(12) United States Patent
Kim et al.

(10) Patent No.: US 8,982,166 B2
(45) Date of Patent: Mar. 17, 2015

(54) DISPLAY DEVICE AND DRIVING METHOD THEREOF

(75) Inventors: Il Nam Kim, Yongin (KR); Minwoo Kim, Yongin (KR); Soomin Baek, Yongin (KR); Jae-Kyoung Kim, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 616 days.

(21) Appl. No.: 13/200,330

(22) Filed: Sep. 23, 2011

(65) Prior Publication Data

US 2012/0169800 A1 Jul. 5, 2012

(30) Foreign Application Priority Data

Dec. 29, 2010 (KR) ..... 10-2010-0138065

(51) Int. Cl.
*G09G 5/10* (2006.01)
*G09G 3/36* (2006.01)

(52) U.S. Cl.
CPC ..... *G09G 3/3655* (2013.01); *G09G 2310/0251* (2013.01)
USPC ..... 345/691; 345/690; 345/692

(58) Field of Classification Search
CPC ..... G09G 3/3655; G09G 2310/0251
USPC ..... 345/87–107, 204–212, 690–692; 315/169.1–169.3; 330/255, 269; 349/39, 141
See application file for complete search history.

(56) References Cited

U.S. PATENT DOCUMENTS

| | | | | |
|---|---|---|---|---|
| 5,442,370 | A * | 8/1995 | Yamazaki et al. | 345/94 |
| 6,819,310 | B2 | 11/2004 | Huang et al. | |
| 7,453,430 | B2 * | 11/2008 | Park et al. | 345/89 |
| 7,456,813 | B2 * | 11/2008 | Leo et al. | 345/92 |
| 7,663,619 | B2 * | 2/2010 | Morita | 345/212 |
| 7,859,504 | B2 * | 12/2010 | Furihata et al. | 345/98 |
| 7,868,869 | B2 * | 1/2011 | Shin et al. | 345/107 |
| 8,228,274 | B2 * | 7/2012 | Chung et al. | 345/87 |
| 8,269,705 | B2 * | 9/2012 | Kim et al. | 345/89 |
| 8,405,685 | B2 * | 3/2013 | Chang et al. | 345/690 |
| 2004/0125090 | A1 * | 7/2004 | Hudson | 345/204 |
| 2004/0239667 | A1 * | 12/2004 | Takahashi | 345/212 |
| 2005/0040889 | A1 * | 2/2005 | Tsuchi | 330/255 |
| 2005/0099378 | A1 * | 5/2005 | Kim | 345/99 |
| 2005/0259059 | A1 * | 11/2005 | Park et al. | 345/89 |
| 2006/0050035 | A1 * | 3/2006 | Leo et al. | 345/89 |

(Continued)

FOREIGN PATENT DOCUMENTS

| | | | |
|---|---|---|---|
| JP | 2000-322031 | A | 11/2000 |
| KR | 10 2009-0074458 | A | 7/2009 |

*Primary Examiner* — Prabodh M Dharia
(74) *Attorney, Agent, or Firm* — Lee & Morse, P.C.

(57) ABSTRACT

A display device includes a display panel having a plurality of source and gate lines and a plurality of pixels at intersection points of the gate lines and source lines, a gate driver configured to output a plurality of gate driving signals for driving the gate lines, a source driver configured to output a plurality of source driving signals for driving the source lines, a gray voltage generator configured to supply a plurality of gray scale voltages to the source driver, and a common voltage generator configured to generate a plurality of common voltages having different levels and to alternately supply one of the generated common voltages in sequence to the pixels per frame, the source driver being configured to output a source driving signal in response to a data signal in accordance with a level of the common voltage supplied by the common voltage generator.

17 Claims, 11 Drawing Sheets

(56) References Cited

U.S. PATENT DOCUMENTS

| | | | | |
|---|---|---|---|---|
| 2006/0152462 | A1* | 7/2006 | Furihata et al. | 345/98 |
| 2007/0242020 | A1* | 10/2007 | Uehara | 345/98 |
| 2007/0262938 | A1* | 11/2007 | Kim | 345/92 |
| 2008/0143668 | A1* | 6/2008 | Shin et al. | 345/107 |
| 2008/0143700 | A1* | 6/2008 | Shin et al. | 345/208 |
| 2008/0150871 | A1* | 6/2008 | Park | 345/98 |
| 2008/0238850 | A1* | 10/2008 | Watanabe | 345/90 |
| 2008/0291223 | A1* | 11/2008 | Yamazaki et al. | 345/690 |
| 2009/0167659 | A1* | 7/2009 | Kim et al. | 345/89 |
| 2009/0231257 | A1* | 9/2009 | Ooki et al. | 345/89 |
| 2009/0322660 | A1* | 12/2009 | Chung et al. | 345/87 |
| 2011/0074761 | A1* | 3/2011 | Xiao et al. | 345/211 |

* cited by examiner

DISPLAY DEVICE AND DRIVING METHOD THEREOF

CROSS-REFERENCE TO RELATED APPLICATIONS

This U.S. non-provisional patent application claims priority under 35 U.S.C. §119 of Korean Patent Application No. 10-2010-0138065, filed on Dec. 29, 2010, the entire contents of which are hereby incorporated by reference.

BACKGROUND

The present disclosure herein relates to a display device and a driving method thereof. As a type of user interface, mounting a display device, e.g., a flat panel display device, on an electronic system may be required. For example, flat panel display devices may have light weight, thin structure, short/small dimensions, and low power consumption. Recently, research is actively being conducted on electronic paper, i.e., e-paper, display devices that do not require background lighting or continuous recharging.

The e-paper display devices apply an electromagnetic field to a conductive material and thus allow the conductive material to have motility. That is, the e-paper display devices distribute charged particles between thin-film flexible substrates, and then change polarity of the electromagnetic field to change the directional arrangement of the charged particles, thereby displaying data. In this case, when the directional arrangement of the charged particles is made in any polarity, since position of the particles is not changed due to memory effect although a voltage is removed, an image may be maintained as-is, i.e., unchanged. Thus, the displayed image may have an appearance of ink-printed on paper.

Consequently, visual fatigability of the e-paper display devices may be very low because self light emission is not performed, thereby allowing convenient use, e.g., actually reading a book. Furthermore, the e-paper display devices secure flexibility and portability using a flexible substrate, thereby drawing attention as a future flat panel display technology. Moreover, as described above, since a realized image is maintained for a relatively long time until a substrate is reset, power consumption may be very low, thereby facilitating use of the e-paper display devices as portable display devices.

SUMMARY

The present disclosure provides a driving method of a display device which has a very fast response time like e-paper display devices.

Embodiments of the inventive concept provide a display device. The display device may include a display panel having a plurality of gate lines, a plurality of source lines perpendicularly intersecting the gate lines, and a plurality of pixels at intersection points of the gate lines and source lines, a gate driver configured to output a plurality of gate driving signals for driving the gate lines, a source driver configured to output a plurality of source driving signals for driving the source lines in response to a data signal, a gray voltage generator configured to supply a plurality of gray scale voltages to the source driver, and a common voltage generator configured to generate a plurality of common voltages having different levels and to alternately supply one of the generated common voltages in sequence to the pixels per frame, the source driver being configured to output a source driving signal in response to the data signal in accordance with a level of the common voltage supplied by the common voltage generator.

The common voltage generator may include a Pulse Width Modulation (PWM) circuit configured to generate the common voltages, and a common voltage selector configured to alternately and sequentially supply the generated common voltages to the pixels per frame.

The display device may further include a timing controller configured to output a common voltage control signal to indicate a start of one frame, the common voltage generator alternately and sequentially supplying the common voltages to the pixels per frame, in synchronization with the common voltage control signal.

The source driving signal of the source driver may be a gray scale voltage corresponding to a difference between a common voltage output by the common voltage selector and a pixel voltage corresponding to the data signal.

Wherein when the PWM circuit generates a Q number of common voltages (where Q is a positive integer), the common voltage selector may be configured to supply a same common voltage as a Qth frame to the pixels in a Q+1st frame, and the source driver may be configured to output a gray scale voltage, which has a same polarity as a common voltage of the Qth frame, as the source driving signal in the Q+1st frame.

The common voltage selector may be configured to supply a predetermined common voltage among the plurality of common voltages to the pixels in the Q+2nd frame, and the source driver may be configured to output a gray scale voltage having the same level as a common voltage of the Q+2nd frame, as the source driving signal.

The predetermined common voltage may be a ground voltage.

The Q+1st frame that may be a pre-discharge frame in which a polarity of a common voltage supplied to the pixel is the same as a voltage polarity of the source driving signal, and the Q+2nd frame may be a discharge frame in which a level of the common voltage supplied to the pixel is the same as a voltage level of the source driving signal.

Each of the pixels may be an electrophoretic pixel.

Other embodiments of the inventive concept may include a driving method of a display device, which includes a plurality of gate lines, a plurality of source lines which perpendicularly intersect the gate lines, and a plurality of pixels which are respectively formed at intersection points of the gate lines and source lines. The method may include generating a plurality of common voltages having different levels, supplying one of the common voltages alternately and sequentially to the pixels per frame, and outputting a gray scale voltage to the source lines in response to a data signal, the gray scale voltage being output in accordance with a level of the common voltage supplied to the pixels.

Outputting the gray scale voltage may include outputting voltage corresponding to a difference between the common voltage output to the pixels and a pixel voltage corresponding to the data signal.

Generating the plurality of common voltages may include generating a Q number of common voltages (where Q is a positive integer) in a Pulse Width Modulation (PWM) circuit, and supplying one of the common voltages may include supplying a same common voltage as a Qth frame to the pixels in a Q+1st frame.

Outputting the gray scale voltage may include outputting to the source lines in the Q+1st frame a gray scale voltage having a same polarity as a common voltage of the Qth frame.

Supplying of one of the common voltages may further include supplying a predetermined common voltage among the plurality of common voltages to the pixels in a Q+2nd frame, and outputting a gray scale voltage may further include driving the source lines to a gray scale voltage having a same level as a common voltage of the Q+2nd frame.

The predetermined common voltage may be a ground voltage.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art.

Figure 1:
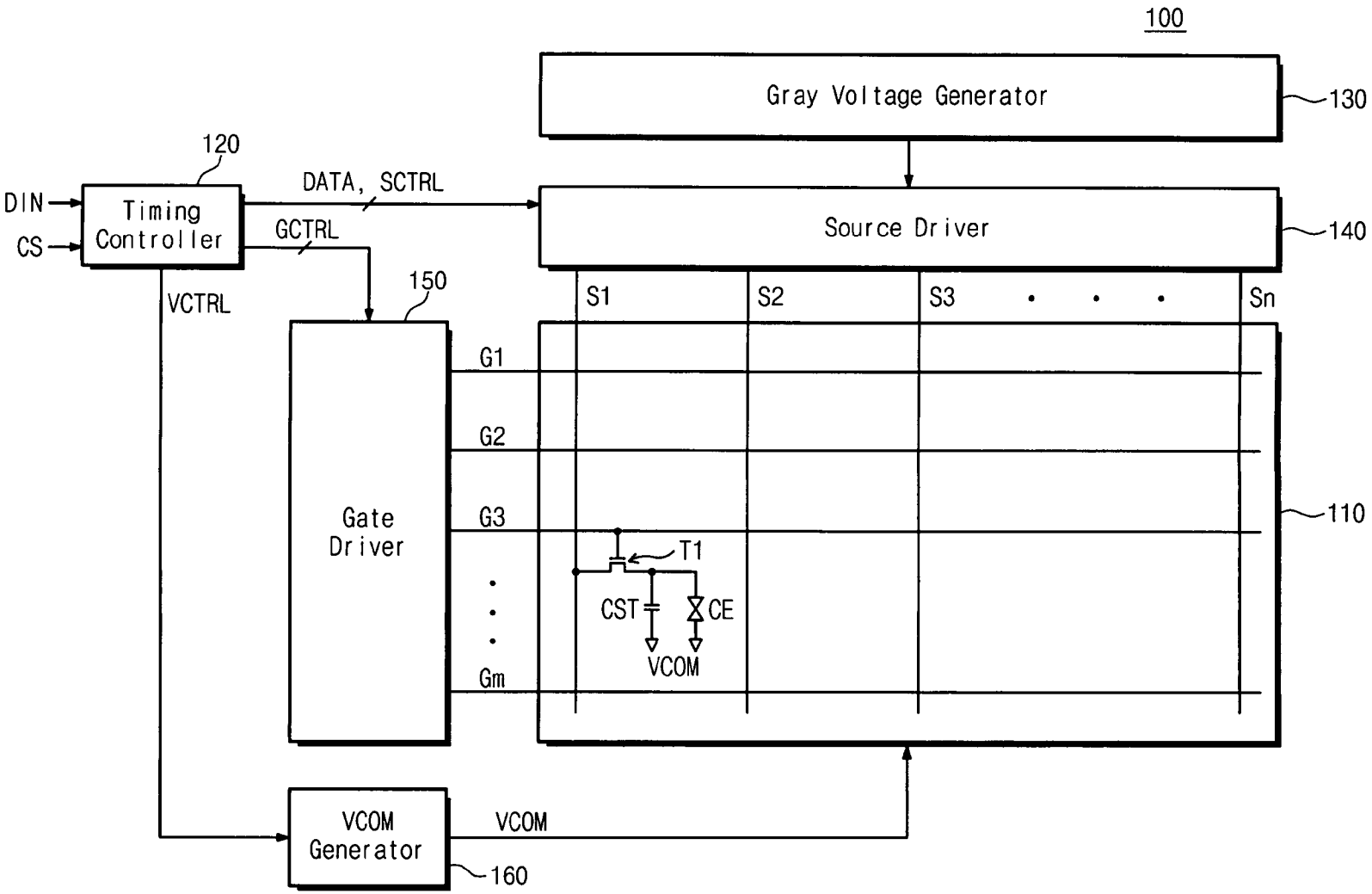
FIG. 1 is a block diagram illustrating a configuration of a display device according to an embodiment of the inventive concept.

FIG. 1 is a block diagram illustrating a configuration of a display device according to an embodiment of the inventive concept. Referring to FIG. 1, a display device 100 according to an embodiment of the inventive concept includes a display panel 110, a timing controller 120, a gray voltage generator 130, a source driver 140, a gate driver 150, and a common voltage generator 160.

The display panel 110 includes a plurality of gate lines, a plurality of source lines that perpendicularly intersect the gate lines, and a plurality of pixels that are respectively formed at the intersection points of the gate lines and source lines, e.g., the pixels are arranged in a matrix structure. Each of the pixels includes a thin film transistor T1 having a gate electrode connected to a gate line and a source electrode connected to a source line, an electrophoretic capacitor CE having one end connected to a drain electrode of the thin film transistor T1, and a storage capacitor CST having one end connected to the drain electrode of the thin film transistor T1. Another end of the electrophoretic capacitor CE and another end of the storage capacitor CST are connected to a common voltage VCOM. In such a pixel structure, the gate lines are sequentially selected by the gate driver 150, and when a pulse type of gate-on voltage is applied to the selected gate line, a thin film transistor of a pixel connected to the selected gate line is turned on. Subsequently, the source driver 140 applies a source driving signal to each of the source lines. The source driving signal is applied to the electrophoretic capacitor CE and the storage capacitor CST through the thin film transistor T1 to drive the capacitors CE and CST, and thus a certain display operation is performed. The electrophoretic capacitor CE displays data in white or black according to a voltage that is applied to both ends thereof. The storage capacitor CST maintains the electrically polarized state of dispersed liquid in the electrophoretic capacitor CE.

The timing controller 120 converts an external data signal DIN input from the outside into a data signal DATA that may be processed by the source driver 140, and outputs the data signal DATA to the source driver 140. The timing controller 120 provides a source control signal SCTRL to the source driver 140, provides a gate control signal GCTRL to the gate driver 150, and provides a common voltage control signal VCTRL to the common voltage generator 160. Herein, the gate control signal GCTRL includes a gate start pulse and a gate shift clock.

The gray voltage generator 130 generates a plurality of gray scale voltages. The gray voltage generator 130 provides a positive level of voltage, a negative level of voltage, and a ground level of voltage to the source driver 140, based on characteristic of the electrophoretic capacitor. For example, the gray voltage generator 130 generates a positive voltage of about +15 V, a negative voltage of about (−15) V, and voltage of about 0 V. The source driver 140 receives a plurality of gray scale voltages that are generated by the gray voltage generator 130, and outputs a plurality of source driving signals S1 to Sn for driving the source lines in response to the data signal DATA and source control signal SCTRL from the timing controller 120.

The gate driver 150 outputs a plurality of gate driving signals G1 to Gm for sequentially driving the gate lines in response to the gate control signal GCTRL from the timing controller 120. That is, the gate driver 150 sequentially provides a gate-on voltage to the gate lines, and provides a gate-off voltage to gate lines that do not receive the gate-on voltage.

The common voltage generator 160 provides the common voltage VCOM to the display panel 110 in response to the common voltage control signal VCTRL from the timing controller 120. The common voltage generator 160 generates a plurality of common voltages. The common voltage generator 160 alternately selects one common voltage from among the generated plurality of common voltages for each frame, and sequentially provides the selected common voltage to the display panel 110 as the common voltage VCOM. In an embodiment of the inventive concept, a duration where all the gate lines are sequentially driven to the gate-on voltage is one frame.

Figure 2:
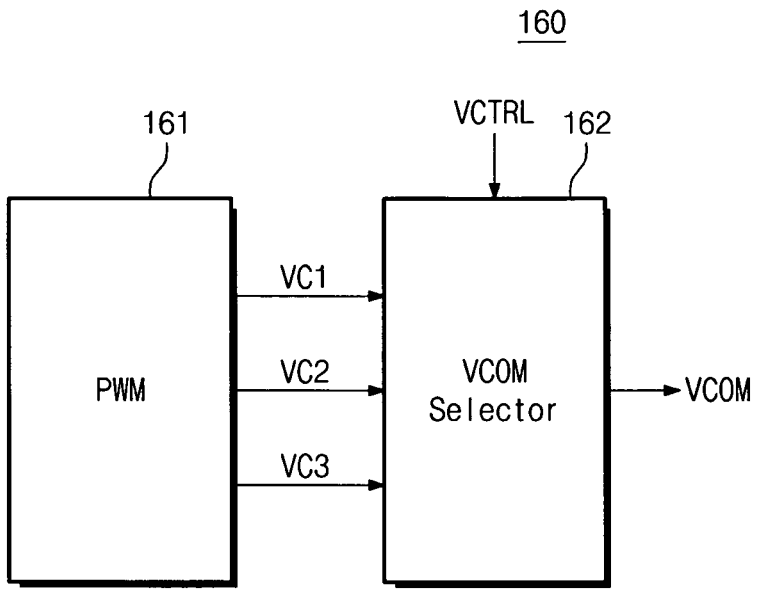
FIG. 2 is a block diagram illustrating a configuration of a common voltage generator according to an embodiment of the inventive concept.

FIG. 2 is a block diagram illustrating a configuration of the common voltage generator 160 in FIG. 1. Referring to FIG. 2, the common voltage generator 160 includes a Pulse Width Modulation (PWM) circuit 161, and a common voltage selector 162.

The PWM circuit 161 oscillates pulses having the same cycle and different duty cycles to generate a plurality of different voltages, e.g., first to third common voltages VC1 to VC3 having different levels. For example, the first to third common voltages VC1 to VC3 generated by the PWM circuit 161 may be differently set based on characteristic of the electrophoretic capacitor.

The common voltage selector 162, e.g., alternately and sequentially, selects one common voltage from among the plurality of voltages generated by the PWM circuit 161, e.g., one voltage among the first to third common voltages VC1 to VC3, per frame. The common voltage selector 162 provides the selected common voltage to the display panel 110 as the common voltage VCOM, in response to the common voltage control signal VCTRL from the timing controller 120 of FIG. 1. For example, the common voltage control signal VCTRL may be a signal that indicates the start of each frame.

Figure 3:
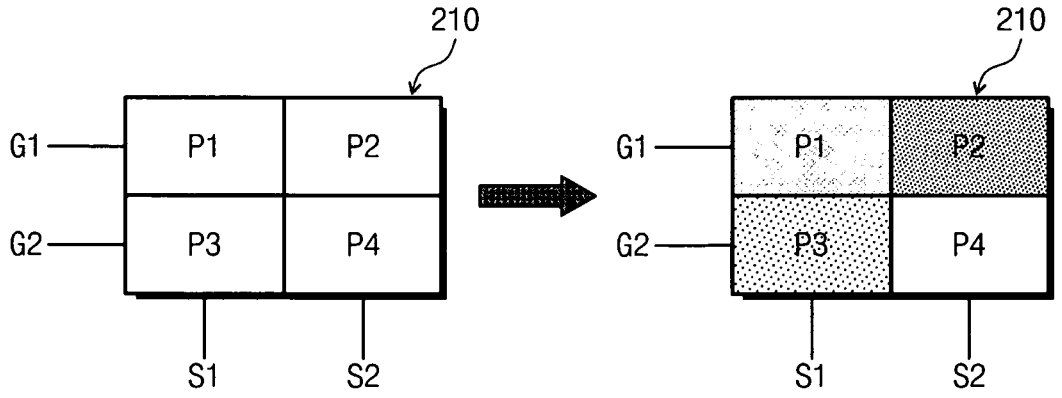
FIG. 3 is a diagram illustrating an image which is displayed on a display panel according to an embodiment of the inventive concept.

FIG. 3 is a diagram illustrating an image which is displayed on a display panel according to an embodiment of the inventive concept. A display panel 210 in FIG. 3 exemplarily illustrates only a portion of the display panel 110 in FIG. 1. Referring to FIG. 3, the display panel 210 includes four pixels P1 to P4 that are connected to two gate driving signals G1 and G2 and to two source driving signals S1 and S2.

Figure 4:
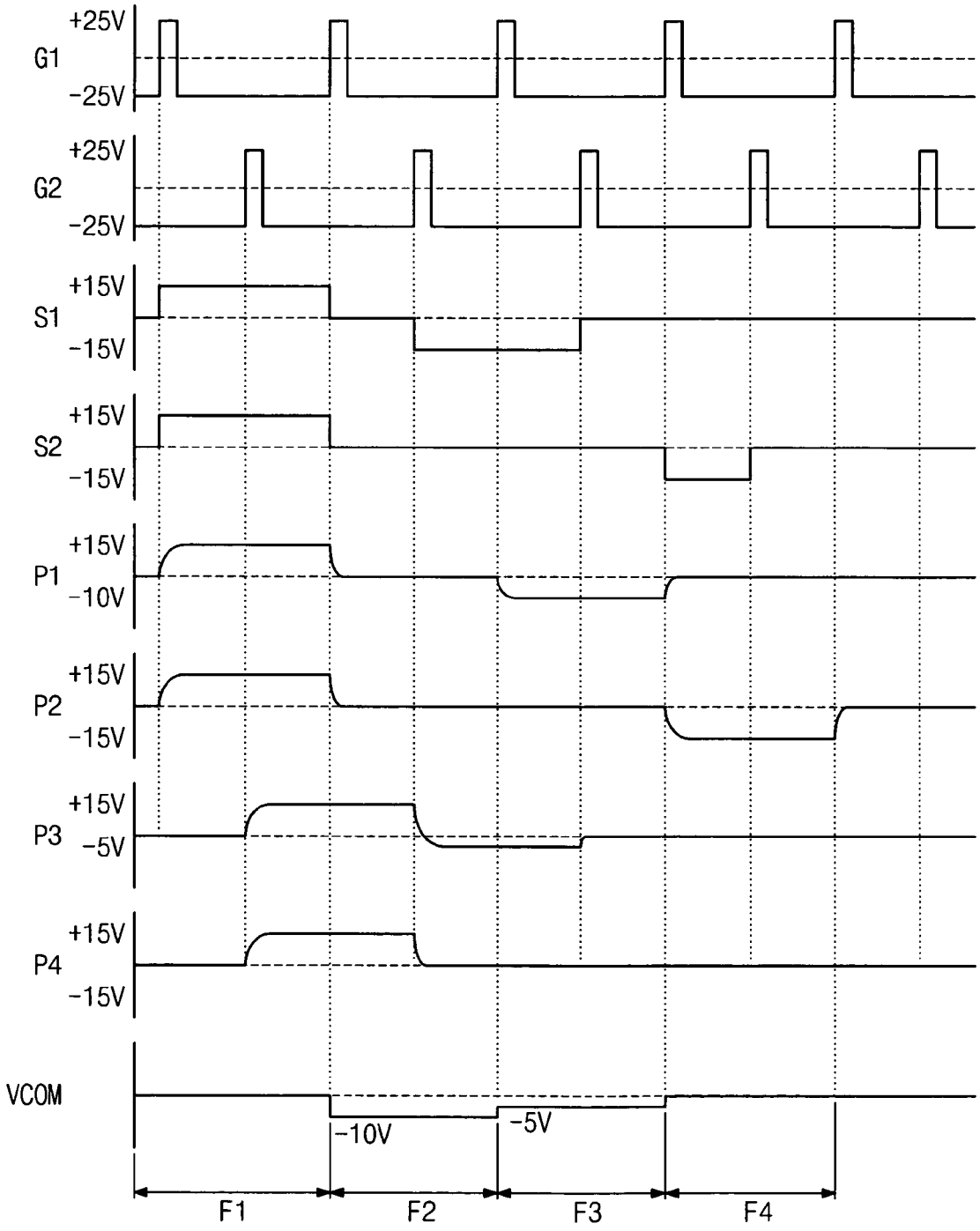
FIG. 4 is a timing diagram showing change of gate driving signals and source driving signals according to an embodiment of the inventive concept.

An operation, which performs control for white to be displayed in the pixels P1 to P4 of the display panel 210 and then performs control for different gray-scale blacks to be displayed in respective pixels, will be described below with reference to FIG. 4. FIG. 4 is a timing diagram showing change of gate driving signals and source driving signals according to an embodiment of the inventive concept for driving the display panel of FIG. 3.

Referring to FIGS. 3 and 4, the gate driving signals G1 and G2 are sequentially activated to about +25V. In an embodiment of the inventive concept, the first to third common voltages VC1 to VC3 that are generated by the PWM circuit 161 of FIG. 2 are about 0 V, about (−5) V and about (−10) V, respectively. A white gray scale may be displayed when a voltage of about (+15) V is applied to the pixels P1 to P4, and various black gray scales may be displayed when voltages of about (+10) V, about (+5) V, about 0 V, about (−5) V, about (−10) V and about (−15) V are applied to the pixels P1 to P4, respectively.

In a first frame F1, the common voltage selector 162 of FIG. 2 outputs the first common voltage C1 of about 0 V as the common voltage VCOM. At this point, the source driver 140 outputs the source driving signals S1 and S2 of about +15V. Since a voltage difference between the common voltage VCOM and the voltages of the source driving signals S1 and S2 is about (+15) V, the gate driving signals G1 and G2 are sequentially activated, and thus a white gray scale is displayed in all the pixels P1 to P4 of the display panel 210 of FIG. 3 (left side of FIG. 3).

In a second frame F2, the common voltage selector 162 of FIG. 2 outputs the third common voltage VC3 of about (−10) V as the common voltage VCOM. At this point, the source driver 140 outputs the source driving signal S1 of about (−15) V to a source line connected to the pixel P3. Since a voltage difference between the voltage of the source driving signal S1, i.e., about (−15) V, and the common voltage VCOM, i.e., about (−10) V, is about (−5) V, a black gray scale corresponding to about (−5) V is displayed in the pixel P3 of the display panel 210 of FIG. 3 (right side of FIG. 3).

In a third frame F3, the common voltage selector 162 of FIG. 2 outputs the second common voltage VC2 of about (−5) V as the common voltage VCOM. At this point, the source driver 140 outputs the source driving signal S1 of about (−15) V to a source line connected to the pixel P1. Since a voltage difference between the voltage of the source driving signal S1 and the common voltage VCOM is about (−10) V, a black gray scale corresponding to about (−10) V is displayed in the pixel P1 of the display panel 210 of FIG. 3 (right side of FIG. 3).

In a fourth frame F4, the common voltage selector 162 of FIG. 2 outputs the first common voltage VC1 of about 0 V as the common voltage VCOM. At this point, the source driver 140 outputs the source driving signal S2 of about (−15) V to a source line connected to the pixel P2. Since a voltage difference between the voltage of the source driving signal S2 and the common voltage VCOM is about (−15) V, a black gray scale corresponding to about (−15) V is displayed in the pixel P2 of the display panel 210 of FIG. 3 (right side of FIG. 3).

In this way, total seven gray scales of about (+15) V, about (+10) V, about (+5) V, about 0 V, about (−5) V, about (−10) V, and about (−15) V may be displayed using the voltages, e.g., first to third common voltages VC1 to VC3, output by the PWM circuit 161 and the voltages, e.g., three gray scale voltages generated by the gray voltage generator 130, output by the source driver 140. The number of gray scale voltages displayable in the display device 100 is determined according to the number of voltages generated by the PWM circuit 161 and the number of gray scale realization frames.

As described above, a display device with a fast response time, e.g., an e-paper display device, may display a gray scale with a plurality of common voltages in a PAM scheme. However, the source driver 140 outputs the source driving signals S1 to Sn for driving the source lines, based on the voltage level of the common voltage VCOM output by the common voltage generator 160.

Figure 5:
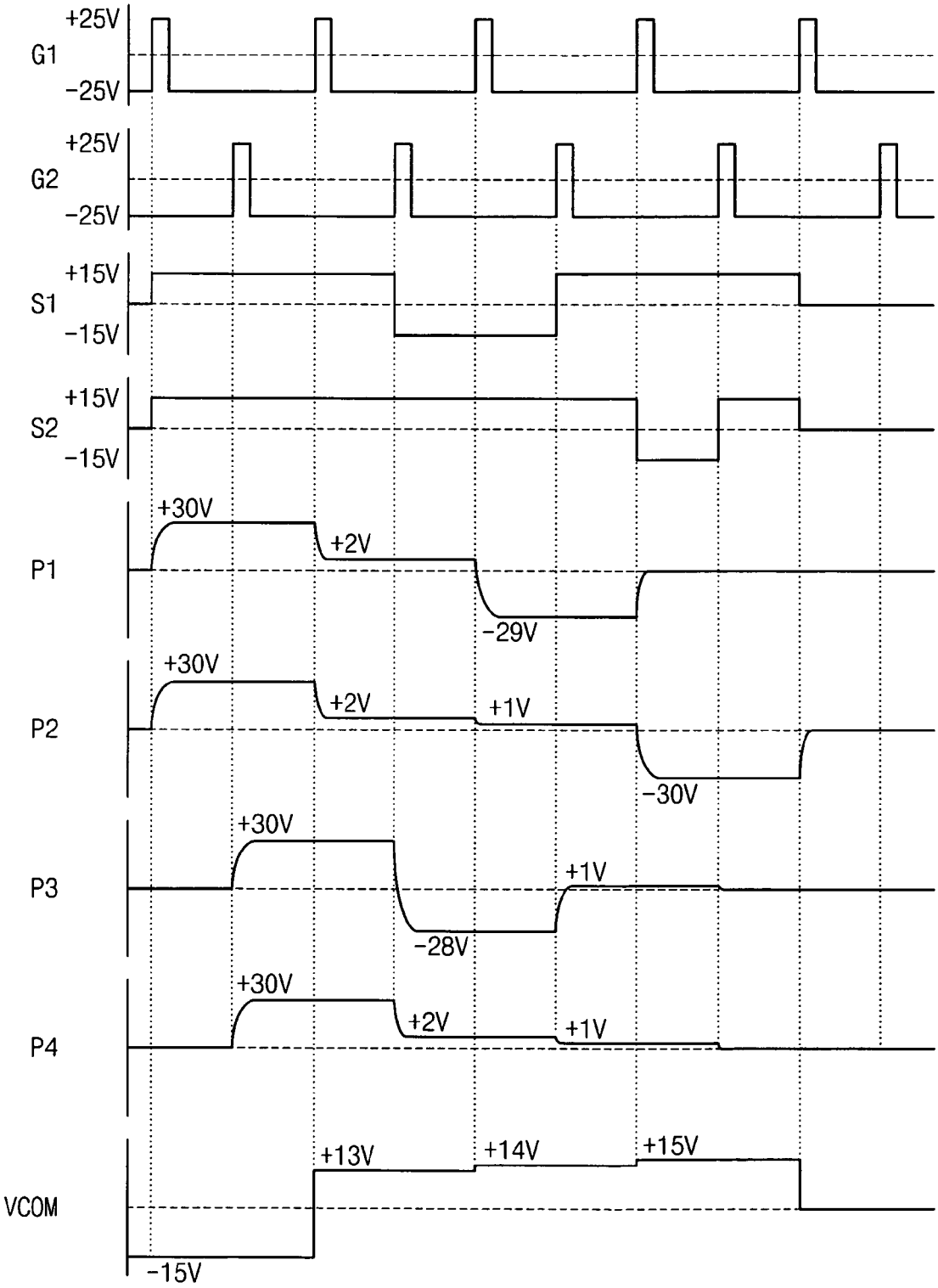
FIG. 5 is a timing diagram showing change of gate driving signals and source driving signals according to another embodiment of the inventive concept.

FIG. 5 is a timing diagram showing change of gate driving signals and source driving signals according to another embodiment of the inventive concept. FIG. 5 shows change of gate driving signals and source driving signals when the first to third common voltages VC 1 to VC3 generated by the PWM circuit 161 of FIG. 2 are about (+13) V, about (+14) V, and about (+15) V, respectively.

In detail, referring to FIG. 5, the PWM circuit 161 inverts the third common voltage VC3 of about (+15) V in order to output an additional voltage, i.e., a fourth common voltage VC4 of about (−15) V. At this point, a white gray scale corresponding to about (+30) V and various black gray scales respectively corresponding to voltages of about (+29) V, about (+28) V, about (+2)V, about (+1) V, about 0 V, about (−1)V, about (−2) V, about (−28) V, about (−29) V, and about (−30) V may be displayed in the pixels P1 to P4 of FIG. 2.

Figure 6A:
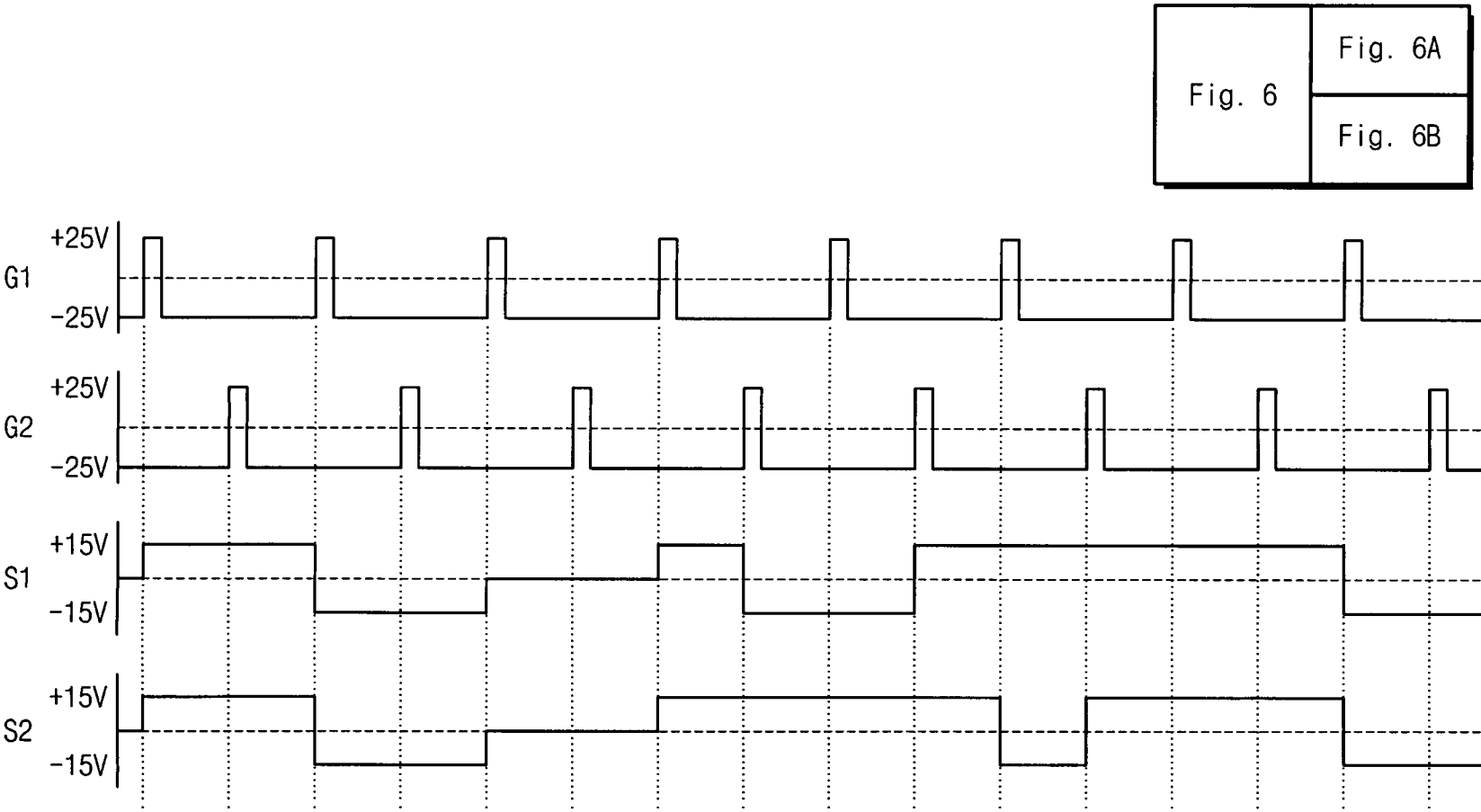
FIG. 6 is a timing diagram showing change of gate driving signals and source driving signals according to another embodiment of the inventive concept.
Figure 6B:
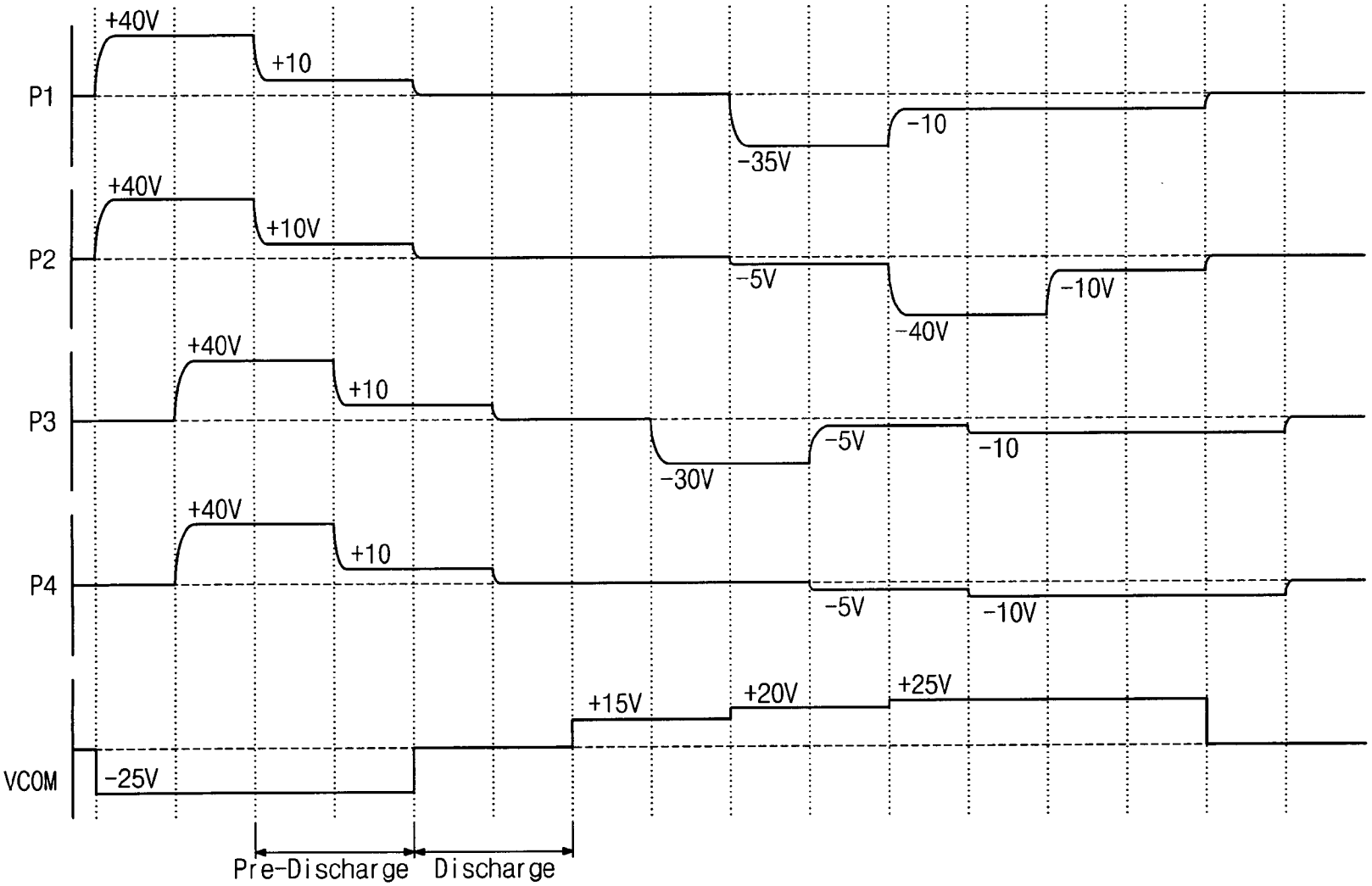

FIGS. 6A and 6B are parts of a timing diagram showing change of gate driving signals source driving signals according to another embodiment of the inventive concept. FIG. 6A shows change of gate driving signals and source driving signals, and FIG. 6B shows the pixels P1 through P4, and the first to third common voltages VC1 to VC3 generated by the PWM circuit 161 of FIG. 2 with respective values of about (+15) V, about (+20) V, and about (+25) V.

In detail, the PWM circuit 161 inverts the third common voltage VC3 of about (+25) V in order to output an additional voltage, i.e., a fourth common voltage VC4 of about (−25) V. At this point, a white gray scale corresponding to about (+40) V and various black gray scales respectively corresponding to voltages of about (+30) V, about (+15) V, about (+10) V, about (+5) V, about 0 V, about (−5) V, about (−10) V, about (−15) V, about (−30) V, and about (−40) V may be displayed in the pixels P1 to P4 of FIG. 2.

Referring to FIG. 6B, the display device 100 has a pre-discharge mode and a discharge mode. When the PWM circuit 161 of FIG. 2 generates a Q number of common voltages, a Q+1st frame is driven in the pre-discharge mode, where a common voltage supplied to a pixel has the same polarity as that of a source driving signal, and a Q+2nd frame is driven in the discharge mode where the common voltage supplied to the pixel has the same level as that of the source driving signal.

Figure 7:
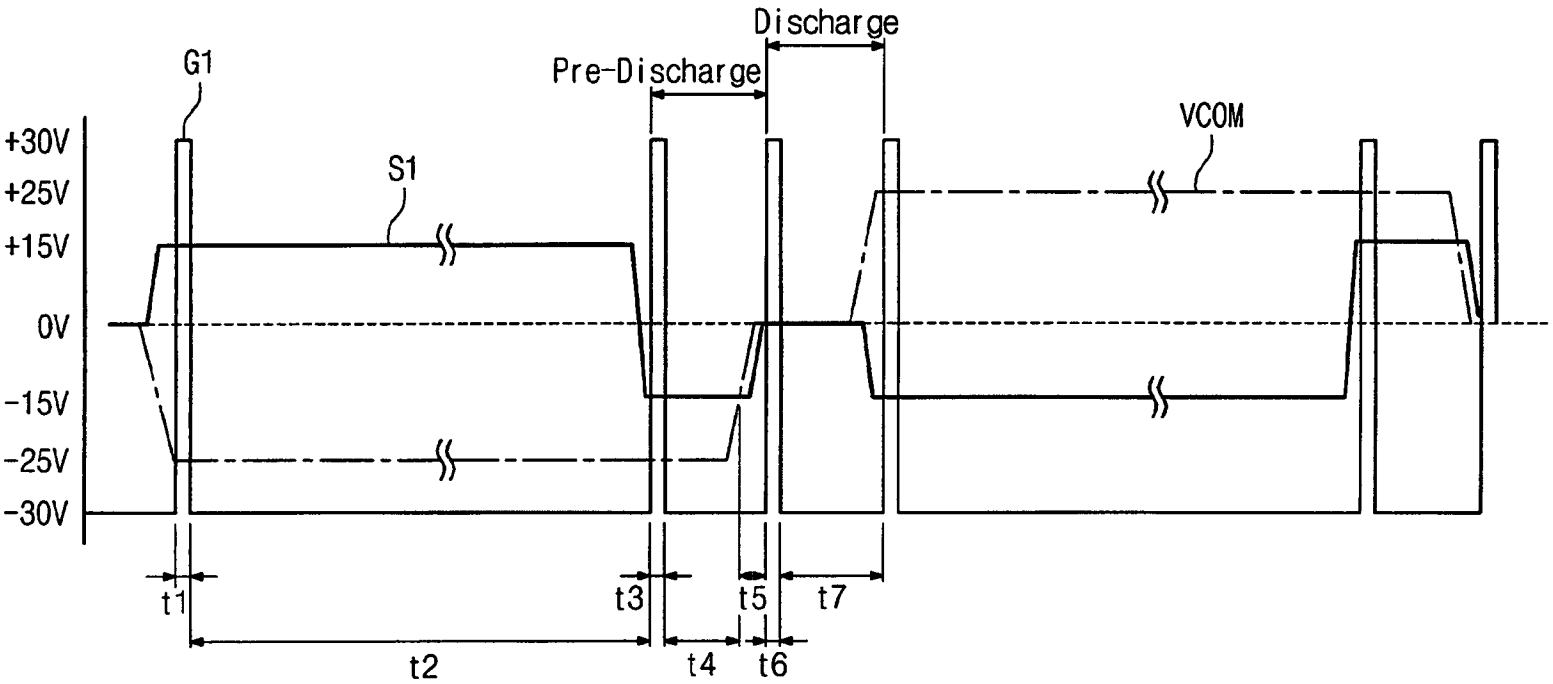
FIG. 7 is a timing diagram exemplarily showing change of gate driving signals and source driving signals in a display device which operates in the pre-discharge mode and the discharge mode.

FIG. 7 is a timing diagram exemplarily showing change of gate driving signals and source driving signals in a display device which does not operate in the pre-discharge mode and the discharge mode. FIG. 7 shows change of gate driving signals and source driving signals identical to those of FIG. 6, i.e., when the first to third common voltages are about (+15) V, (+20) V, and (+25) V, respectively.

FIG. 7 is a timing diagram exemplarily showing change of gate driving signals and source driving signals in a display device which operates in the pre-discharge mode and the discharge mode.

Referring to FIG. 7, in a Qth frame, the source driving signal is about (+15) V and the common voltage VCOM is about (−25) V. Subsequently, when the source driving signal S1 is shifted to about (−15) V and the common voltage VCOM is shifted to about (+25) V, the Q+1st frame is driven in the pre-discharge mode, and the Q+2nd frame is driven in the discharge mode.

FIGS. 8A to 8G are diagrams illustrating voltage differences which are applied to a thin film transistor and both ends of an electrophoretic capacitor, in respective durations of FIG. 7.

Figure 8A:
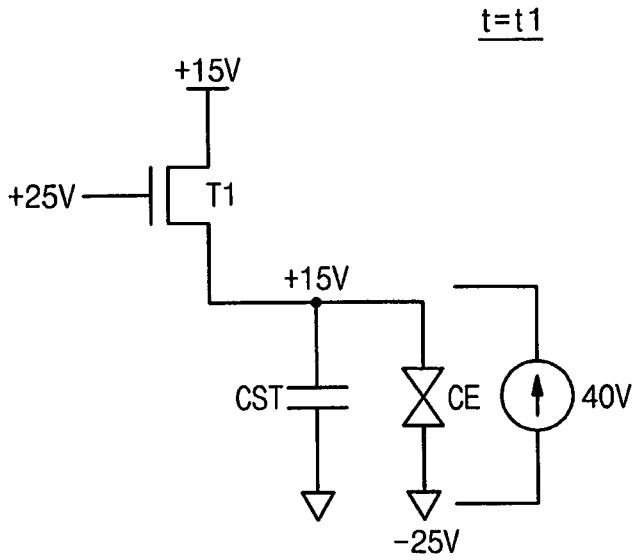
FIGS. 8A to 8G are diagrams illustrating voltage differences which are applied to a thin film transistor and both ends of an electrophoretic capacitor, in respective durations of FIG. 7.

Referring to FIGS. 7 and 8A, in a first duration t1, the common voltage VCOM of about (−25) V is applied to one end of the electrophoretic capacitor CE when the gate driving signal G1 of about (+25) V is applied to the gate of the thin film transistor T1 and the source driving signal S1 of about (+15) V is applied to a source line. At this point, since a voltage difference between both ends of the electrophoretic capacitor CE is about 40 V, an image corresponding to about 40 V may be displayed.

Figure 8B:
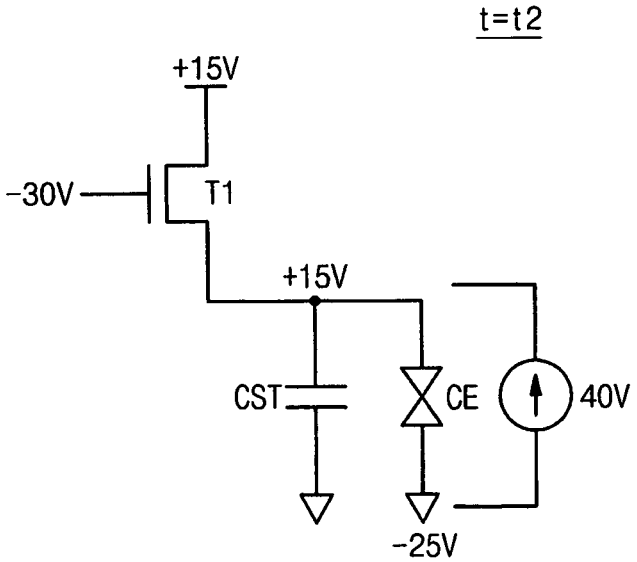

Referring to FIGS. 7 and 8B, in a second duration t2, the gate driving signal G1 of about (−30) V is applied to the gate of the thin film transistor T1, the source driving signal S1 of about (+15) V is applied to a source line, and the common voltage VCOM of about (−25) V is applied to one end of the electrophoretic capacitor CE.

Figure 8C:
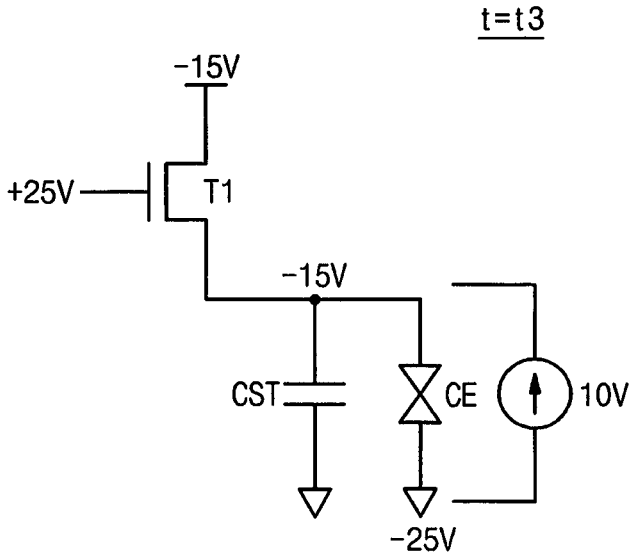

Referring to FIGS. 7 and 8C, in a third duration t3, the gate driving signal G1 of about (+25) V is applied to the gate of the thin film transistor T1, the source driving signal S1 of about (−15) V is applied to a source line, and the common voltage VCOM of about (−25) V is applied to one end of the electrophoretic capacitor CE. At this point, since a voltage difference between both ends of the electrophoretic capacitor CE is about (+10) V, an image corresponding to about 10 V may be displayed. In this way, in the pre-discharge mode, the voltage polarity of the source driving signal S1 is changed to a negative polarity identically to the common voltage VCOM that is supplied to a pixel.

Figure 8D:
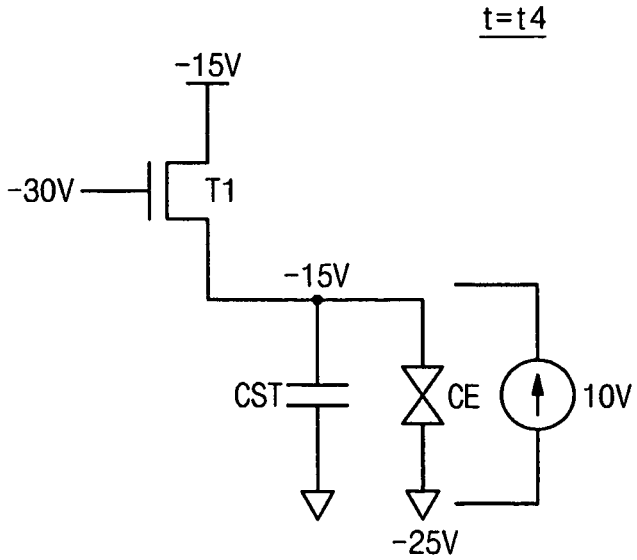

Referring to FIGS. 7 and 8D, in a fourth duration t4, the gate driving signal G1 of about (−30) V is applied to the gate of the thin film transistor T1, the source driving signal S1 of about (−15) V is applied to a source line, and the common voltage VCOM of about (−25) V is applied to one end of the electrophoretic capacitor CE.

Figure 8E:
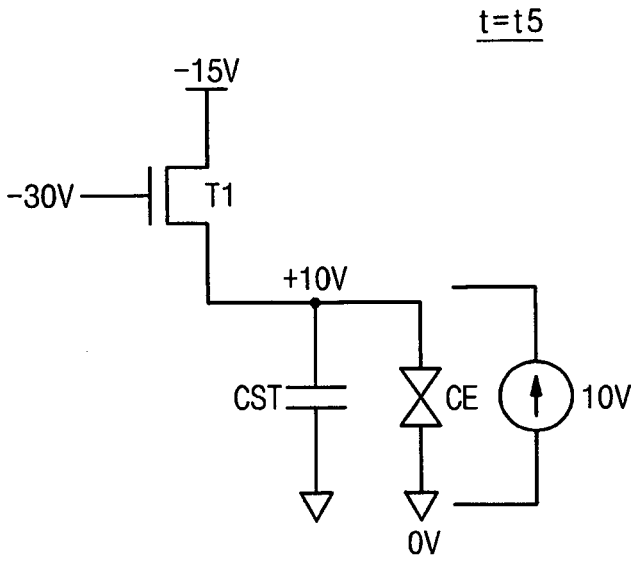

Referring to FIGS. 7 and 8E, in a fifth duration t5, the gate driving signal G1 of about (−30) V is applied to the gate of the thin film transistor T1, the source driving signal S1 of about (−15) V is applied to a source line, and the common voltage VCOM of about 0 V is applied to one end of the electrophoretic capacitor CE.

Figure 8F:
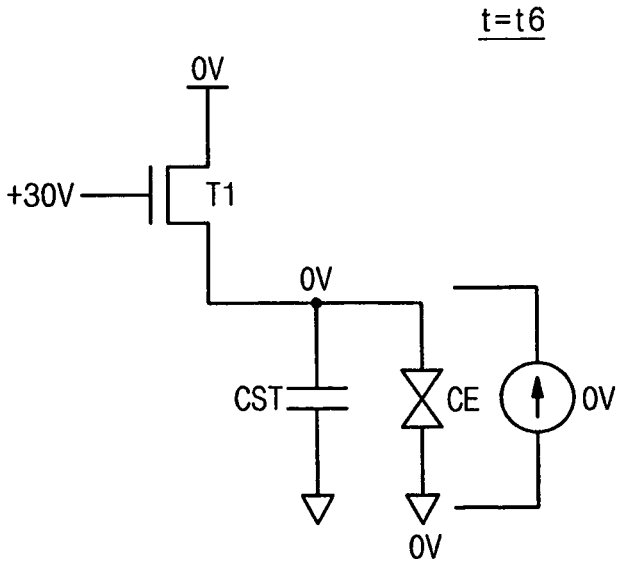

Referring to FIGS. 7 and 8F, in a sixth duration t6, the gate driving signal G1 of about (+30) V is applied to the gate of the thin film transistor T1, the source driving signal S1 of about 0 V is applied to a source line, and the common voltage VCOM of about 0 V is applied to one end of the electrophoretic capacitor CE. At this point, since a voltage difference between both ends of the electrophoretic capacitor CE is about 0 V, an image corresponding to about 0 V may be displayed. In the pre-discharge mode of the Q+2nd frame, the source driving signal S1 and the common voltage VCOM are identically set about 0 V, i.e., a ground voltage level.

Figure 8G:
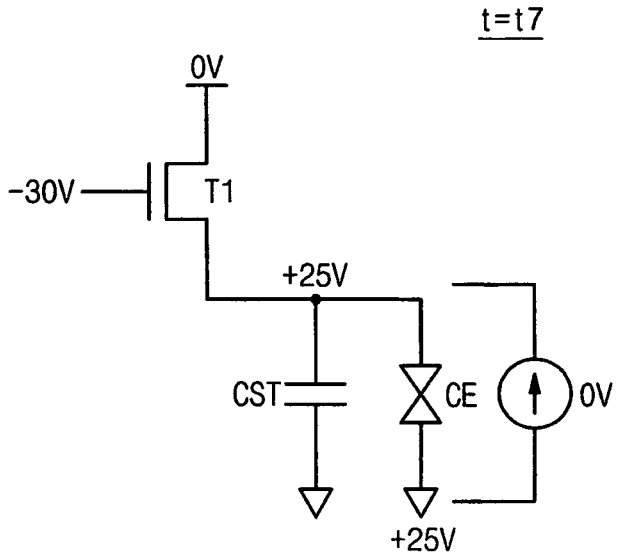

Referring to FIGS. 7 and 8G, in a seventh duration t7, the gate driving signal G1 of about (−30) V is applied to the gate of the thin film transistor T1, the source driving signal S1 of about 0 V is applied to a source line, and the common voltage VCOM of about (+25) V is applied to one end of the electrophoretic capacitor CE. Therefore, even when the common voltage VCOM is shifted from about (−25) V to about (+25) V, a current can be prevented from being leaked in the thin film transistor T1 due to the rapid shift in the voltage level of the drain terminal of the thin film transistor T1.

According to embodiments, various gray scales can be displayed using the PWM circuit, i.e., PWM IC, in the display device having a fast response time.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display device, comprising:

a display panel having a plurality of gate lines, a plurality of source lines perpendicularly intersecting the gate lines, and a plurality of pixels at intersection points of the gate lines and the source lines;

a gate driver to output a plurality of gate driving signals for driving the gate lines;

a source driver to output a plurality of source driving signals for driving the source lines in response to a data signal;

a gray voltage generator to supply a plurality of gray scale voltages to the source driver; and a common voltage generator to generate a plurality of common voltages having different levels and to supply the common voltages to the pixels in different frames, the source driver to output at least one of the source driving signals in response to the data signal, wherein the different levels of the common voltages supplied by the common voltage generator in respective ones of the different frames correspond to different gray scale values, wherein the common voltages include two common voltages applied in consecutive frames and having different levels of a same polarity, and wherein the common voltage generator includes:

a Pulse Width Modulation (PWM) circuit to generate the common voltages; and a common voltage selector to sequentially supply the common voltages to the pixels per the different frames.

2. The display device of claim 1, further comprising a timing controller to output a common voltage control signal to indicate a start of one frame, the common voltage generator sequentially supplying the common voltages to the pixels per the different frames, in synchronization with the common voltage control signal.

3. The display device of claim 2, wherein the source driving signals of the source driver are gray scale voltages corresponding to a difference between respective ones of the common voltages output by the common voltage selector and a pixel voltage corresponding to the data signal.

4. The display device of claim 3, wherein when the PWM circuit generates a Q number of common voltages (where Q is a positive integer), the common voltage selector is configured to supply a same one of the common voltages as a Qth frame to the pixels in a Q+1st frame, and the source driver is configured to output a gray scale voltage, which has a same polarity as the common voltage of the Qth frame, as the source driving signal in the Q+1st frame.

5. The display device of claim 4, wherein:

the common voltage selector is to supply a predetermined common voltage among the plurality of common voltages to the pixels in the Q+2nd frame, and the source driver is to output a gray scale voltage having a same level as a common voltage of the Q+2nd frame, as the source driving signal.

6. The display device of claim 5, wherein the predetermined common voltage is a ground voltage.

7. The display device of claim 5, wherein:

the Q+1st frame is a pre-discharge frame in which a polarity of a corresponding one of the common voltages supplied to the pixel is equal to a voltage polarity of the source driving signal, and the Q+2nd frame is a discharge frame in which a level of the common voltage supplied to the pixel is the same as a voltage level of the source driving signal.

8. The display device of claim 1, wherein each of the pixels is an electrophoretic pixel.

9. A method for driving a display device, the method comprising:

generating a plurality of common voltages having different levels;

supplying the common voltages to pixels in different frames; and outputting gray scale voltages to source lines in response to a data signal, the gray scale voltages being output in accordance with the common voltages supplied to the pixels, wherein the different levels of the common voltages in respective ones of the different frames correspond to different gray scale values, and wherein the common voltages include two common voltages applied in consecutive frames and having different levels of a same polarity, wherein:

the common voltages are generated by a Pulse Width Modulation (PWM) circuit, and the common voltages are sequentially supplied to the pixels per the different frames.

10. The driving method of claim 9, wherein outputting the gray scale voltage includes outputting a voltage corresponding to a difference between the common voltage output to the pixels in a respective one of the different frames and a pixel voltage corresponding to the data signal.

11. The driving method of claim 10, wherein:

generating the plurality of common voltages includes generating a Q number of common voltages (where Q is a positive integer) in the Pulse Width Modulation (PWM) circuit, and supplying one of the common voltages includes supplying a same common voltage as a Qth frame to the pixels in a Q+1st frame.

12. The driving method of claim 11, wherein outputting the gray scale voltage includes outputting to the source lines in the Q+1st frame a gray scale voltage having a same polarity as a common voltage of the Qth frame.

13. The driving method of claim 12, wherein:

supplying of one of the common voltages further comprises supplying a predetermined common voltage among the plurality of common voltages to the pixels in a Q+2nd frame, and outputting a gray scale voltage further comprises driving the source lines to a gray scale voltage having a same level as a common voltage of the Q+2nd frame.

14. The driving method of claim 13, wherein the predetermined common voltage is a ground voltage.

15. An apparatus, comprising:

a voltage generator to generate a plurality of common voltages; and a driver to apply source signals to pixels with the common voltages, wherein a difference between a first source signal and a first common voltage in a first frame corresponds to a first amount, and a difference between a second source signal and a second common voltage in a second frame corresponds to a second amount different from the first amount, wherein the first and second frames are consecutive frames and the first and second common voltages have a same polarity, wherein the first amount corresponds to a first gray scale value and the second amount corresponds to a second gray scale value different from the first gray scale value, and wherein the voltage generator includes:

a Pulse Width Modulation (PWM) circuit to generate the common voltages; and a common voltage selector to sequentially supply the common voltages to the pixels per the first and second frames.

16. The apparatus as claimed in claim 15, wherein:

the pulse width modulation circuit is to generate a plurality of voltages with different duty cycles, and the selector is to select the voltages to correspond to the common voltage to be applied in respective ones of the first and second frames, wherein each of the duty cycles correspond to a different one of the common voltages.

17. The apparatus as claimed in claim 15, wherein the first difference and the second difference have a same magnitude but different signs.

* * * * *